US005584786A

United States Patent [19]

Almeda

[11] Patent Number: 5,584,786

[45] Date of Patent: Dec. 17, 1996

[54] ABDOMINAL EXERCISE DEVICE

[76] Inventor: Thomas M. Almeda, 14 Aster Ter., Key West, Fla. 33040

[21] Appl. No.: 334,954

[22] Filed: Nov. 7, 1994

Related U.S. Application Data

[63] Continuation-in-part of Ser. No. 10,503, Jul. 7, 1993, Pat. No. Des. 353,173.

[51] Int. Cl.[6] ..... A63B 26/00

[52] U.S. Cl. ..... 482/142; 482/140

[58] Field of Search ..... 482/142, 140, 482/104; 5/633, 635

[56] References Cited

U.S. PATENT DOCUMENTS

| | | | |
|---|---|---|---|
| D. 152,394 | 1/1949 | Ceverha . | |
| D. 237,813 | 11/1975 | England . | |
| D. 267,028 | 11/1982 | Spisak . | |
| D. 284,394 | 6/1986 | Bengtson et al. . | |
| 1,904,039 | 4/1933 | Bruder . | |
| 3,102,280 | 9/1963 | Williams . | |
| 3,561,022 | 2/1971 | James . | |
| 4,207,635 | 6/1980 | Leroy . | |
| 4,210,322 | 7/1980 | Pritchard . | |
| 4,405,129 | 9/1983 | Stuckey | 5/630 |
| 4,752,067 | 6/1988 | Colonello . | |
| 4,796,315 | 1/1989 | Crew | 5/630 |
| 4,902,003 | 2/1990 | Buoni . | |
| 4,923,187 | 5/1990 | Mombrinie | 5/630 |
| 4,953,857 | 9/1990 | Lemire | 482/104 |
| 5,033,742 | 7/1991 | Johnson et al. . | |
| 5,076,579 | 12/1991 | Rickey . | |
| 5,147,267 | 9/1992 | Kunewalder . | |
| 5,304,109 | 4/1994 | Shockley | 482/104 |

*Primary Examiner*—Lynne A. Reichard
*Attorney, Agent, or Firm*—Malloy & Malloy, P.A.

[57] ABSTRACT

The present invention is directed towards an improved abdominal exercise device and includes a body made of a rigid, substantially strong yet lightweight material having a substantially flat, generally rectangular shaped base portion, a pair of spaced, generally parallel, upstanding sidewalls, each operably connected to the base portion and having a substantially semicircular shape, and an upper portion operably connected to and spanning the base portion and sidewalls in a covering relation and further defining a planar surface also having a substantially semicircular shape. The exercise device may include a groove formed in and extending longitudinally across the upper spanning portion and may further include a cushion sized and configured to substantially cover the upper spanning portion, formed of a foam padding and soft water resistant fabric. Finally, the exercise device of this invention may be securely mounted onto a standard exercise bench and may also include a handle so that it can be easily transported from one work-out location to another.

14 Claims, 2 Drawing Sheets

ABDOMINAL EXERCISE DEVICE

STATEMENT OF RELATED APPLICATIONS

This application is a continuation in part to the application filed on Jul. 7, 1993 and having Ser. No. 29/010,503, for which a Notice of Allowance has issue, now U.S. Pat. No. Des. 353,173.

BACKGROUND OF THE INVENTION

1. Field of the Invention

The present invention relates in general to an exercise device and in particular to a portable, easy to use exercise device especially suited for sit-up type exercises. The present invention is further directed towards reducing the stress placed on an exerciser's lower back region during the performance of sit-up type exercises.

2. Description Of the Related Art

It is now well understood that exercise is both important and beneficial to the human body. In recent years, it has become evident that regular exercise, when incorporated into a person's routine along with a healthy diet, helps one to keep a positive outlook, extend life and avoid many of the problems typically associated with old age. As a result, numerous exercise devices have been developed. Some are designed to provide a user with a cardiovascular workout, while others offer resistance-type exercise. Yet other exercise devices allow the user to isolate a particular muscle group such as the abdominals or the gluteus, and focus on exercising that group in particular. The present invention relates to the latter type of devices.

It has long been understood that sit-up type exercises are highly beneficial. When a person performs sit up exercises, he is not only strengthening his abdominal area but other muscle groups which interconnect with the abdominal muscles and which provide support for the back and spinal column. Unfortunately, if sit up exercises are not done properly they can cause undue stress and trauma to the lower back region. Consequently, many devices for assisting with sit-up type exercises have been developed. However, nothing in the prior art discloses or suggests the present invention. More specifically, there remains a need in the art for an abdominal exercise device which is shaped to support and reduce the stress on the back of the exerciser while at the same time, providing a one piece device which is compact, portable, easy-to-use and easy-to-store. Further, there remains a need for such an abdominal exercise device which is also more comfortable when in use and thereby serves to improve the psychological attitude of and motivate the exerciser while performing abdominal exercises.

SUMMARY OF THE INVENTION

The present invention is directed towards an improved abdominal exercise device. The exercise device comprises a body made of a rigid, substantially strong yet lightweight material and having a substantially flat, generally rectangular shaped base portion, a pair of spaced, generally parallel, upstanding sidewalls, each operably connected to the base portion and having a substantially semicircular shape, and an upper portion operably connected to and spanning the base portion and the side walls in a covering relation and further defining a co-planar surface between the side walls which corresponds with the substantially semicircular shape of the side walls. The exercise device may include a groove formed in and extending longitudinally across the upper spanning portion and may further include a cushion sized and configured to substantially cover the upper spanning portion, formed of foam padding and soft water resistant fabric. Finally, the exercise device of this invention may also include a handle to easily transport the device from one work-out location to another, and means for securely mounting the device onto a standard exercise bench.

A primary object of the present invention is to provide an improved exercise device that minimizes stress to the back of an exerciser in the performance of sit-up type exercises.

A second object of this invention is to substantially support the back of an exerciser when performing sit-up exercises and to minimize pressure on the lower lumbar region of the back.

Still another object of this invention is to provide an improved exercise device for safely performing sit-up exercises which are effective to strengthen the abdominal muscles and interconnected muscle groups such as those supporting the back and spinal column.

Still another object of the present invention is to provide a one piece exercise device which is lightweight and portable so as to allow it to be easily transported from location to location.

A feature of the present invention is that it is compact and easy to store.

Yet another object of this invention is to provide an exercise device that can be used either on the floor or mounted to a standard exercise bench of the kind found in gymnasiums, athletic clubs, homes, etc.

Another object of this invention is to offer an abdominal exercise device which can easily be utilized by all types of exercisers whether young or old, short or tall, athletic or not.

An advantage of this invention is that it can be used in routines for both advanced and beginning exercisers.

Another feature of this invention is that it is designed to be attractive and if desired, may be colorful and may also include indicia thereon.

Still another advantage of this invention is that it improves the exerciser's psychological attitude towards performing sit-up exercises.

Yet another object of the present invention is to provide a simple, one-piece exercise device which is relatively easy and inexpensive to manufacture.

BRIEF DESCRIPTION OF THE DRAWINGS

For a fuller understanding of the nature of the present invention, reference should be had to the following detailed description taken in connection with the accompanying drawings in which:

FIG. 1-A is a cross sectional view of the invention taken along lines 1-A of FIG. 1.

Like reference numerals refer to like parts throughout the several views of the drawings.

DETAILED DESCRIPTION OF THE PREFERRED EMBODIMENT

Figure 1:
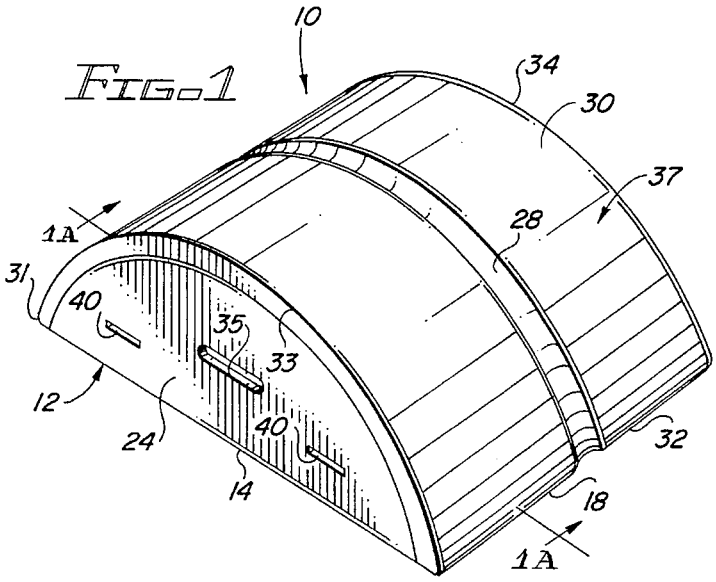
FIG. 1 is a perspective view showing a first embodiment of the present invention.
Figure 2:
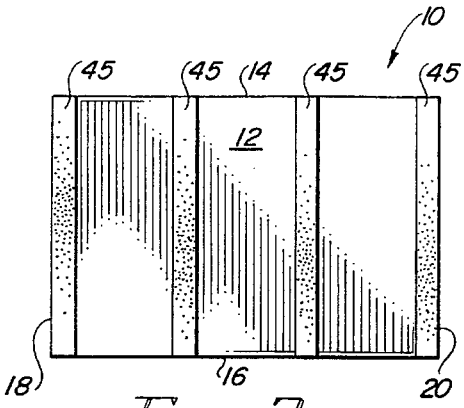
FIG. 2 is a bottom view of the invention shown in FIG. 1.
Figure 3:
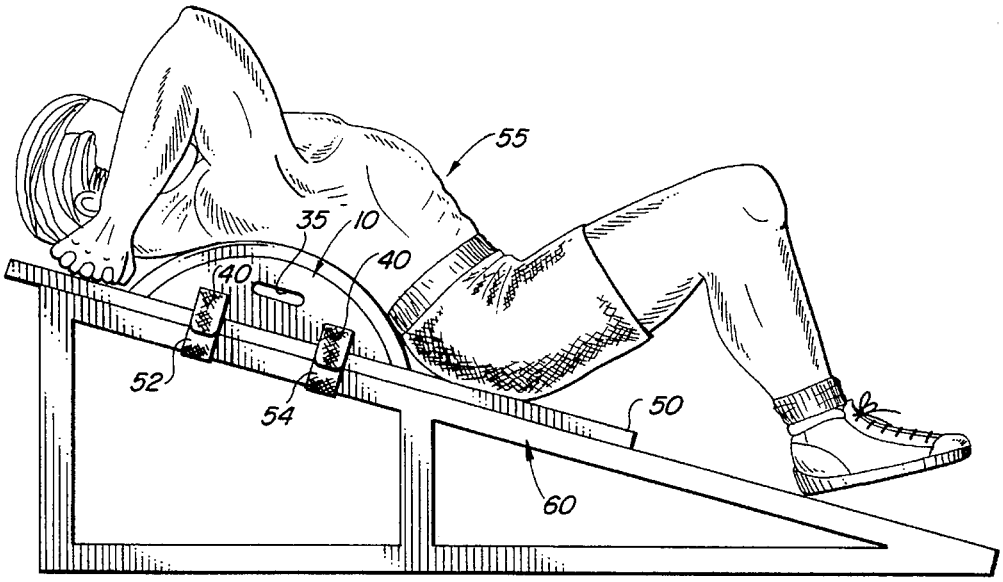
FIG. 3 is a side view of the invention shown in FIG. 1 and is illustrated in use by an exerciser and mounted to a standard exercise bench.

As illustrated in FIGS. 1–3, the present invention is directed towards an improved abdominal exercise device, generally indicated as 10. The exercise device comprises a substantially flat lower base portion, 12, which in the preferred embodiment is rectangular in shape, although it will be understood that the device would function equally as well in a square, trapezoidal, or similarly shaped base portion. As best shown in FIG. 2, the base 12 includes a first pair of spaced, generally parallel opposite edges 14 and 16 and a second pair of spaced, generally parallel opposite edges 18 and 20 which are perpendicular to the first pair 14 and 16. A first upstanding side wall, 24, is operably connected at its lower end to the base portion 12, preferably at one of the first pair of opposite and parallel edges, such as at 14. As illustrated in the drawings, the upper end of sidewall 24 has a substantially semicircular shaped configuration. Although not clearly shown in the drawings, a second upstanding side wall which is a mirror image to first side wall 24 is operably connected at its lower end to the base portion at the other of the first pair of opposite and parallel edges, such as at 16, and also has an upper end having a substantially semicircular shaped configuration. The device further includes an upper portion 30 which spans opposite edges of the base 12 in a covering relation and as best shown in FIG. 1, is sized and configured to form a co-planar surface between the sidewalls which is substantially semicircular in shape, corresponding sidewalls 24. More particularly, upper spanning portion 30 has a first pair of opposite edges 31, 32 which are operably connected to opposite edges 18 and 20, respectively, of the base portion 12. Upper spanning portion 30 also includes a second pair of opposite edges, 33 and 34, each of which is operably connected to one of the upstanding side walls 24 along its upper ends, as shown in FIGS. 1–3. In the preferred embodiment, the overall size and dimension of device 10 allows it to be conveniently transported and stored in places such as under a bed or even in the overhead compartment on an airplane, train, etc..

In the most preferred embodiment, the exercise device 10 is a simple, integrally formed, one piece body. While the device 10 could be made of metal, wood, or any other suitably strong material, it is preferably made of a molded plastic material, such as urethane. It is contemplated that when the body of device 10 is integrally formed of a suitable plastic material, it has the advantages of being substantially rigid, yet lightweight, and of being relatively inexpensive to manufacture. Additional advantages to forming the body of device 10 from a suitable plastic material include providing a smooth surface for the user, which would be less likely to cause injury to the user and/or to tear or snag clothing. It will however, be appreciated by those skilled in the art that the base, sidewalls and upper portion of the device could be formed of another type of material such as wood or metal, and in such a case, sidewalls 24 could be connected to the base portion edges 14, 16 and the upper spanning portion 30 could be interconnected with the base 12 and sidewalls 24 by other means such as adhesives, nails, staples, or other securing means known in the art which will nonetheless ensure that the device is sufficiently sturdy to support the upper body weight of an exerciser.

As has been described, the device 10 will support the exerciser's upper body weight when in use, as best shown in FIG. 3. Because the exerciser's back directly contacts the device 10 along the rigid surface of upper spanning portion 30, the preferred embodiment of the device will include a narrow groove 28, formed within upper spanning portion 30. As shown in FIG. 1, groove 28 extends longitudinally and at least substantially across upper spanning portion 30 between opposite edges 31 and 32 thereof. Groove 28 will be preferably sized and configured in width and depth to comfortably receive therein the spine and vertebrae of the exerciser when the device is used.

Figure 1A:
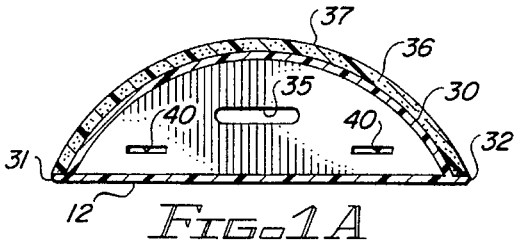

Because the exerciser directly contacts the device 10 along the rigid surface of upper spanning portion 30, it is preferable to provide the device with a cushion 37 for comfort. As shown in FIG. 1A, the cushion is preferably sized and configured to cover the spanning upper portion 30 and ideally will include at least one layer of foam padding 36 beneath a soft, water resistant fabric. While the cushion 37 can be fixedly secured to the device 10 by way of adhesives, in the preferred embodiment it is removably attached to the upper spanning portion 30 of device 10 by way of snaps or Velcro™ material. In this way cushion 37 can be detached from device 10 for washing so as to remove odor or stains caused by sweat. As shown in FIG. 1, cushion 37 may also be formed to provide a groove therein, which in a most preferred embodiment will correspond with groove 28 formed within the device 10. As has been described, the groove is sized and configured to comfortably receive the spine and vertebrae of the exerciser utilizing the device 10.

In the preferred embodiment, the device 10 will also include at least one handle 35 thereon, as shown in FIG. 3. In the most preferred embodiment where the device is integrally formed of a suitable plastic material, the handle will be integrally formed within the device 10, and positioned within upstanding side walls 24. Alternatively, handle 35 may be operably connected to the device, and preferably will also be located on one of the upstanding side walls 24. In such case, handle 35 may be comprised of a separate metal or wood handle attached to the device by conventional fasteners such as bolts, screws, etc. It will be readily appreciated that handle 35 provides means for easily transporting the device 10 from location to location, whether for traveling or for transporting the device from home to a gym, as is about to be described.

As shown in FIG. 1, the device 10 can be used directly on the ground or a floor surface. Alternatively, the device 10 can be mounted onto a standard exercise bench 60. These exercise benches are commonly used for sit-ups and are found in gyms, athletic clubs and even some homes. While certain exercise benches are permanently affixed in one position, others are movable so as to adjust the incline of the bench, and thus the difficulty for performing the sit-up. Further, the sit-up can be performed on these benches in either a "head elevated" position as shown in FIG. 3, or in a "feet elevated position" shown in FIG. 5, thought to be more difficult as the exerciser must work against gravity. The improved exercise device of this invention is designed for use on both permanently affixed and moveable exercise benches and also for use in either a "head elevated" position or the more advanced "feet elevated" position.

While the device 10 may simply be placed on an exercise bench 60 for use, the preferred embodiment will include means for mounting the device to an exercise bench in a secured manner. As shown in FIG. 3, in the preferred embodiment the mounting means comprise at least one strap, 52. More preferably, strap 52 will be operably connected at one end to the device 10. For example, device 10 may include therein a receiving slot 40, preferably located on upstanding side wall 24 which is sized, configured and disposed for securely connecting the strap 52 to the device 10. Strap 52 is of sufficient length to wrap down, around the sides of the device 10 and exercise board 60 and to pass thereunder and back up to another receiving slot in opposite side wall 24 of device 10 for fastening. Alternatively, device 10 may include another strap in mirror image to strap 52, which is also operably connected to the device 10 at its other upstanding sidewall. Straps 52 can then be tied, buckled, snapped or Velcroed™ together to snugly retain the device 10 on the exercise bench 60. However, as shown in FIG. 3, in the preferred embodiment, there will be at least a pair of straps 52 and 54 extending from one side of the device and extending underneath the exercise bench 60 to retain the device in place on the bench.

Figure 5:
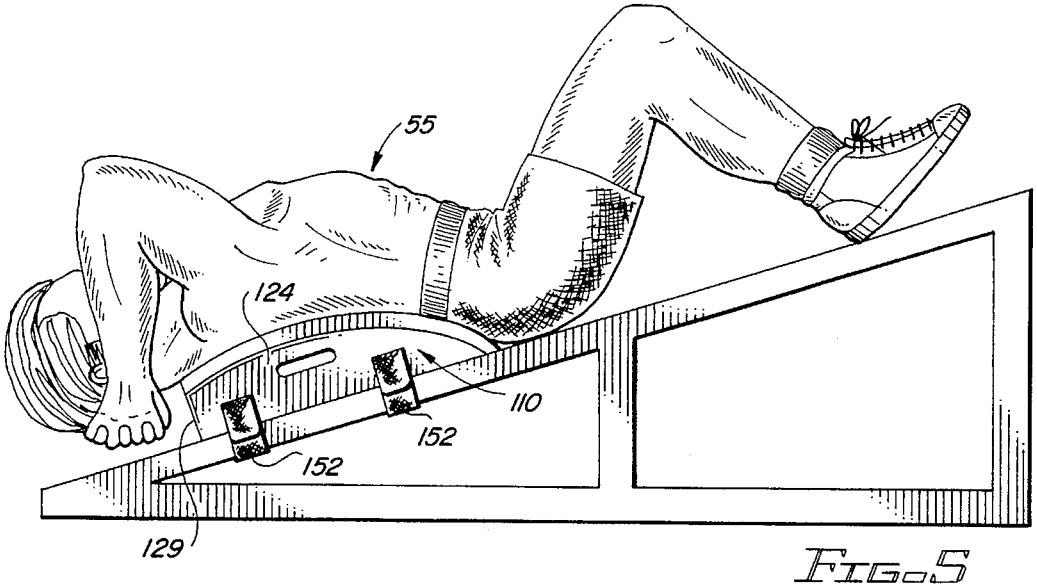
FIG. 5 is a side view of the device shown in FIG. 5 and illustrated in use and mounted to a standard exercise bench.

Turning to FIG. 2, in one embodiment of the device 10, the bottom surface of the base portion 12 is shown to include at least one strip of suitable material 45, for providing friction against a supporting surface or floor surface. Preferably, the bottom surface includes a plurality of material strips 45, made of rubber, the frictional action of which helps to prevent device 10 from skidding down an inclined exercise bench such as shown in FIGS. 3 or 5. Alternatively, it is possible to use the device 10 in combination with a specially designed, thick and skid-proof mat, 50 which can be placed under the device 10 when used on either a floor surface or exercise bench, as shown in FIG. 3. The mat 50, may also contain similarly placed material strips of rubber. Alternatively, the strips of material on mat 50 could be made of Velcro™ for removable attachment to similarly aligned Velcro™ strips 45 on device 10.

Figure 4:
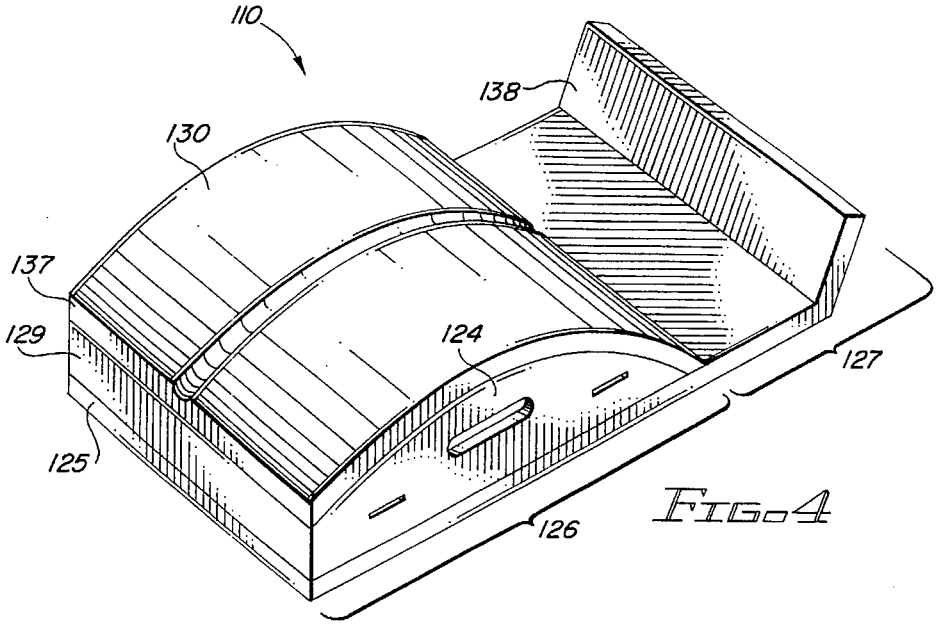
FIG. 4 is a perspective view showing a second embodiment of the present invention.

Referring now to FIG. 4, there is shown an alternative embodiment of the exercise device, designated generally at 110. Device 110 is substantially similar to device 10 which has already been described and will not be repeated here. However, as shown in FIG. 4 device 110 has been adapted for use in combination within a specially designed support member 125. In particular, it will be seen that the generally semicircular shaped configuration formed by the upstanding side walls 124 and upper spanning portion 130 of the device is slightly less symmetrical, as indicated at 129 so as to offer a more secure fit within support member 125. Preferably, device 110 is removably secured within support member 125, which may be accomplished by providing both the undersurface of device 110 and the inner exposed surface of support member 125 with aligned, interlockable strips of Velcro™ material which correspond each other when device 110 is mounted within member 125.

As shown in FIG. 4, support member 125 is comprised of a large first portion 126 and a smaller second portion 127. As has been described, first portion 126 is sized and configured to receive and snugly retain therein, the device 110. The smaller second portion 127 is integral with and extends from first portion 126 and is sized and disposed to define a pelvic cradle, generally "L" shaped as shown in FIG. 4. This pelvic cradle portion 127 is configured to comfortably receive and cradle therein the lower pelvic area and buttocks of an exerciser when the device 110 is used with support member 125. Further, pelvic cradle portion 127 will assist the exerciser with the performance of sit-up type exercises in several ways, for example, by almost forcing a tilt in the exerciser's pelvic area and thus, the exerciser's knees into an up position. Of course, support member 125 will likewise be made of a rigid, substantially strong yet lightweight material, and preferably a moldable plastic material which carries the advantages discussed previously. Support member 125 is also compact, and has an overall dimension suitable for being easily stored and/or carried from location to location.

As before, the exerciser directly contacts the device 110 and therefore, a cushion 137 is preferably provided for comfort, which is substantially similar to cushion 37, the features of which have already been described. It will be readily understood that because the exerciser also directly contacts the pelvic cradle portion 127 of the support member, it is also preferable to provide portion 127 with a separate cushion 138, which like cushion 37, 137 preferably includes a groove formed therein to comfortably receive the tail bone section of the exerciser's spine and is preferably made of at least one layer of foam padding and soft water resistant fabric.

It will further be appreciated that device 110 can be used for exercise either in combination with support member 125, or by itself as shown in FIG. 5. Means for mounting the device to a standard exercise bench or slant board, 160 are preferably included on the device 110. The mounting means may comprise at least one flexible strap, 152 and other features which have already been described in connection with FIG. 3. As another option, support member 125 can include means for removable securement to various elevation devices, 270 such as shown in FIG. 6, which are designed to incline support member 125 and device 110 within it for a more difficult workout.

Figure 6:
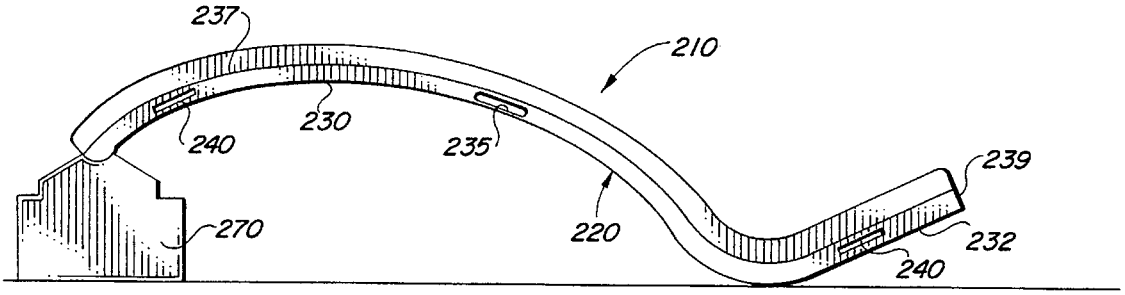
FIG. 6 is a side view showing a third embodiment of the present invention.

Illustrated in FIG. 6 is yet another embodiment 210 of the exercise device. This embodiment comprises an integral, generally sinusoidal shaped base member 220 including a first curved portion 230 and a second curved portion 232. Device 210 is also made of a substantially rigid yet lightweight material, preferably a moldable plastic material. The first curved portion 230 has an upper surface and a lower surface which are both generally semicircular, and in use will act to support the back of the exerciser. The second curved portion 232 extends from first curved portion 230 to contact the floor or support surface at a proximal zone 238, whereas its distal zone 239 forms a generally right angle to said first portion. Second curved portion 232 is further sized and configured to comfortably receive and cradle therein the pelvic area and buttocks of the exerciser when the device 210 is in use. Further, a groove can be formed within the device 210 to extend substantially across both first and second portions, 230, 235 which is sized to comfortably receive therein the spine and vertebrae of the exerciser. It will be readily understood that because of the device's generally sinusoidal shape along both the upper surface and lower surface, several devices 210 can easily be stacked one-on-top of the other.

It will also be readily understood that because the exerciser directly contacts the device 210, it is preferable to provide a cushion 237 for the device, the features of which are analogous to cushion 37 which have heretofore been described. Device 210 can also be used either directly on a floor surface or mounted on an exercise bench 60. Device 210 may include means for mounting the device to an exercise bench in a secure fashion, such as at least one flexible strap connected to the device at a receiving slot such as 240, which features have already been described previously. Device 210 may also include a handle 235 thereon for ease in transporting the device. Finally, as illustrated in FIG. 6, device 210 can be utilized with one or more elevating devices 270 to adjust the incline level of the device 210 to provide for an easier or more strenuous workout of the abdominal muscles.

The operation of the described invention is believed to be readily apparent and is shown in particular in FIGS. 3 and 5. An exerciser 55 first selects whether to use the device on the floor, mat, exercise bench or in combination with support member 125 and also selects the degree of incline and thus, difficulty for using the device to perform abdominal exercises. Next the exerciser 55 sits on the support surface, with his knees up, and with his lower back in touching contact with the device 10, 110, 210. The exerciser then slowly leans back onto the device, allowing each vertebra of the lower back and then those of the upper back to adjust to the semicircular co-planar surface of the device and simultaneously, further allows the device to help his chest cavity to expand, which facilitates deeper breathing. The exerciser 55 can now start raising his torso upwardly to an inclined position to perform a sit up whereupon the device 10, 110, 210 will support his back and in particular, minimize pressure to his lower back. Exerciser 55 can perform various exercises on the device and as many repetitions of each exercise as desired. It should be pointed out however, that the exercise device of this invention can be effectively used as an aid to warmup the exerciser's body in preparation for other workouts, such as walking, jogging, aerobics, etc.

Since many modifications, variations and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed:

1. An exercise device for use by an exerciser in performing exercises for the abdominal muscles, comprising:

a body sized to generally extend lengthwise from a user's upper shoulder and neck area and advance substantially toward his/her pelvis with a width generally equivalent to or greater than the user's waist made of a rigid, substantially strong yet lightweight material and having:

a) a substantially flat, lower base portion including
a first pair of spaced, generally parallel, opposite edges;
a second pair of spaced, generally parallel, opposite edges generally perpendicular to said first pair of edges;

b) a pair of upstanding sidewalls, each being operably connected to one of said first pair of opposite edges of said base portion and having a substantially semicircle shaped configuration;

c) an upper portion spanning said first and second pair of opposite edges of said base portion in a covering relation, including
a first pair of opposite edges of said upper portion operably connected to said second pair of opposite edges of said base portion, and
a second pair of opposite edges of said upper portion forming a co-planar surface with said side walls and correspondingly abutting said side walls in a substantially semicircular configuration, each of said second pair of upper portion opposite edges being operably connected to one of said upstanding side walls.

2. An exercise device as recited in claim 1 further comprising a groove, formed within said upper spanning portion and extending longitudinally at least substantially across said upper spanning portion between said second pair of opposite edges, said groove being sized and configured to comfortably receive therein a spine and vertebrae of an exerciser.

3. An exercise device as recited in claim 1, wherein said device is formed a rigid plastic material.

4. An exercise device as recited in claim 3, wherein said device is integrally formed.

5. An exercise device as recited in claim 1 further comprising a cushion secured to and sized and configured to substantially cover said upper spanning portion of said device.

6. An exercise device as recited in claim 1 further comprising a cushion removably connected to said device and sized and configured to substantially cover at least said upper spanning portion of said device.

7. An exercise device as recited in claim 5 wherein said cushion includes a groove longitudinally extending within said cushion, said groove being sized and configured to receive the spinal cord of an exerciser therein.

8. An exercise device as recited in claim 1 further comprising means for mounting said device on an exercise bench.

9. An exercise device as recited in claim 8 wherein said mounting means comprise at least one flexible strap operably connected to said device.

10. An exercise device as recited in claim 9 wherein said at least one flexible strap is operably connected to one of said upstanding walls of said device.

11. An exercise device as recited in claim 1 wherein said base portion includes at least one strip of material adhered to an undersurface thereof for providing frictional action against a supporting surface for said exercise device.

12. An exercise device as recited in claim 1 further comprising at least one handle operably connected to said device.

13. An exercise device as recited in claim 12 wherein said handle is integrally formed within said device and positioned on one of said upstanding side walls.

14. An exercise device as recited in claim 12 wherein said handle is secured to upper portion of said upstanding side walls of said device.

* * * * *